US008181681B2

(12) United States Patent
Shin et al.

(10) Patent No.: US 8,181,681 B2
(45) Date of Patent: May 22, 2012

(54) GOLF CLUB HEAD COVER AND METHOD OF USE

(76) Inventors: Brian Shin, Fountain Valley, CA (US); James Kent Jensen, Lehi, UT (US)

( * ) Notice: Subject to any disclaimer, the term of this patent is extended or adjusted under 35 U.S.C. 154(b) by 0 days.

(21) Appl. No.: 12/794,590

(22) Filed: Jun. 4, 2010

(65) Prior Publication Data

US 2011/0073503 A1 Mar. 31, 2011

Related U.S. Application Data

(63) Continuation-in-part of application No. 12/569,398, filed on Sep. 29, 2009, now abandoned.

(51) Int. Cl.
*A63B 57/00* (2006.01)

(52) U.S. Cl. ..... 150/160; 206/315.2; 206/315.4

(58) Field of Classification Search ..... 150/159, 150/160; D21/754; 206/315.2, 315.4, 316.4
See application file for complete search history.

(56) References Cited

U.S. PATENT DOCUMENTS

| | | | | | |
|---|---|---|---|---|---|
| 2,035,529 | A | * | 3/1936 | Bucklin | 150/160 |
| 2,508,525 | A | * | 5/1950 | Le Fevre | 150/160 |
| 2,705,039 | A | * | 3/1955 | Halter | 150/160 |
| 3,117,609 | A | * | 1/1964 | Pio | 150/160 |
| 3,613,760 | A | * | 10/1971 | Koehnle | 150/160 |
| 3,664,399 | A | * | 5/1972 | Neff | 150/160 |
| 3,892,267 | A | * | 7/1975 | Bibeau | 150/160 |
| 4,126,166 | A | | 11/1978 | Hohenstein | |
| 4,195,677 | A | * | 4/1980 | Hagg et al. | 150/160 |
| 4,378,832 | A | * | 4/1983 | Thompson | 150/160 |
| 5,000,238 | A | * | 3/1991 | Zeller | 150/160 |
| 5,050,655 | A | * | 9/1991 | Borenstein | 150/160 |
| 5,109,578 | A | | 5/1992 | Cox | |
| 5,345,987 | A | | 9/1994 | Hagar | |
| 5,611,379 | A | * | 3/1997 | Hoyt et al. | 150/160 |
| 5,735,327 | A | | 4/1998 | Aldcroft et al. | |
| 5,864,925 | A | | 2/1999 | McGee | |
| 5,944,081 | A | | 8/1999 | Aldcroft et al. | |
| 5,988,378 | A | | 11/1999 | Bell, Jr. | |
| 6,116,307 | A | * | 9/2000 | Mangigian et al. | 150/160 |
| 6,119,742 | A | * | 9/2000 | Maeng | 150/160 |
| 6,192,950 | B1 | * | 2/2001 | Maeng | 150/160 |
| 6,202,723 | B1 | * | 3/2001 | Maeng | 150/160 |
| 6,227,269 | B1 | * | 5/2001 | Choe | 150/160 |
| 6,367,625 | B1 | | 4/2002 | Zobel | |
| 6,434,800 | B1 | | 8/2002 | James et al. | |
| 6,820,665 | B2 | | 11/2004 | Bradshaw | |
| 2003/0136485 | A1 | | 7/2003 | Bradshaw | |
| 2003/0136486 | A1 | | 7/2003 | Bradshaw | |
| 2003/0204981 | A1 | | 11/2003 | Boling et al. | |
| 2003/0213711 | A1 | * | 11/2003 | Kang | 206/315.2 |
| 2004/0035729 | A1 | * | 2/2004 | Chang et al. | 206/315.6 |

(Continued)

*Primary Examiner* — Sue Weaver
(74) *Attorney, Agent, or Firm* — John J. Connors; Connors & Assoc. pc.

(57) ABSTRACT

A golf club head cover comprises a pair of complementary cover sections connected to pivot about a manually actuated spring-biased clip member normally biases the cover sections into a closed condition. The clip member includes a pair of handle elements to be gripped between the thumb and one or more fingers by a user and depressed towards each other to move the cover sections so they pivot and spread apart into an open condition. When the head of a golf club is between the spread apart cover sections in the open condition, or is withdrawn, the user releases the grip on the handle elements so the cover sections come together automatically into the closed condition.

15 Claims, 16 Drawing Sheets

U.S. PATENT DOCUMENTS

2004/0144460 A1 7/2004 German
2004/0261924 A1 12/2004 Bradshaw
2006/0226038 A1 10/2006 Lampley
2007/0215256 A1 9/2007 Better
2007/0261772 A1* 11/2007 Chow ..... 150/160
2009/0133790 A1 5/2009 Maeng et al.

* cited by examiner

14

50
A
B
A
50
C
C
52
10d
50
50
D
14
50

FOR LEFT HANDED CLUBS

GOLF CLUB HEAD COVER AND METHOD OF USE

RELATED PATENT APPLICATIONS & INCORPORATION BY REFERENCE

This application is a continuation-in-part application of U.S. application Ser. No. 12/569,398, entitled "Golf Club Head Cover and Method of Use," filed Sep. 29, 2009 now abandoned. This related application is incorporated herein by reference and made a part of this application. Moreover, any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The word "rectangular" includes square.

The words "substantially" and "essentially" have equivalent meanings.

BACKGROUND

U.S. Pat. No. 4,378,832 discloses a manually operated golf club head cover comprising a pair of sections connected by a series of double action-spring loaded hinges along a longitudinal axis. A user needs both hands to open and close this head cover. Consequently, it is inconvenient to use. U.S. Pat. Nos. 2,705,039 and 3,892,267 disclose using a clip member for a golf club head cover, but lack the novel and non-obvious features of our cover as disclosed and claimed herein.

SUMMARY

Our golf club head cover and method of use has one or more of the features depicted in the embodiments discussed in the section entitled "DETAILED DESCRIPTION OF SOME ILLUSTRATIVE EMBODIMENTS." Our head cover is opened with one hand, is maintained open with this one hand, and, as the case may be, the golf club head is removed from or inserted into our opened head cover. Consequently, the user opens our head cover with one hand and, while open, inserts or removes the golf club head with the other hand. Our head cover automatically closes upon release of the user's grip. The claims that follow define our golf club head cover and method of use, distinguishing them from the prior art; however, without limiting the scope of our golf club head cover and method of use as expressed by these claims, in general terms, some, but not necessarily all, of their features are:

One, our golf club head cover comprises body including a pair of cover sections and a clip member connecting the cover sections. The clip member has a manually operable actuator mechanism such as handle elements that project from the connected cover sections. The body has an open condition enabling it to receive the head of a golf club and a closed condition substantially enclosing the club head therein. Each cover section has a predetermined configuration and each includes a perimeter. These perimeters abut when the body is in the closed condition. The cover sections may be connected to pivot about a longitudinal centerline along a backside of the body. In another embodiment an off center reference line divides the body into a large cover section and a much smaller cover section. In other words the cover sections need not be of equal size.

Two, the clip member has an open position and a closed position, and it includes a pair of arms hinged together and a spring element connected to the arms to normally bias the clip member into the closed position. Each arm includes a mounting element and a handle element. One cover section is connected to the mounting element of one arm and the other cover section is connected to the mounting element of the other arm. The handle elements may be positioned opposite each other along a portion of the abutting perimeters. They are oriented so that manually gripping and depressing the handle elements using only one hand overcomes the bias of the spring element. Depressing the handle elements moves the clip member to the open position by pivoting the hinged together arms to separate the cover sections to form the open condition of the body so long as the handle elements are manually depressed. Upon release of manually gripping the handle elements, the spring element moves the separated cover sections together to rejoin the cover sections along the perimeters to form the closed condition of the body. In other words the chip member functions as a single action hinge, namely, only urges the hinge into a closed condition. In one embodiment, only a single clip member is used and it may be positioned substantially centrally a longitudinal centerline in a backside of the enclosure.

Three, each cover section may include a frame covered by a flexible sheet material or each cover section may be molded from a plastic and are substantially rigid. In the case of the sheet covered frame, the frame forms a substantial portion of the perimeter of its corresponding cover section. In either case, the perimeters of each cover section may include a mating segment that mates with a complementary mating segment of the other cover section. For example, in one frame its perimeter has a male cross section, and in the other frame its perimeter has a female cross section, allowing the two cover sections to come together in alignment upon closure.

Four, the body has a topside, and one cover section may have along a segment of its perimeter in the topside a laterally projecting portion. The other cover section may have along a segment of its perimeter in the topside a recess portion that is aligned with and that receives the laterally projecting portion when the body is in the closed condition. The laterally projecting portion and the recess portion may each be substantially semi-circular shaped and they may have a common center when the body is in the closed condition.

Five, in one embodiment, frame members are covered by a flexible sheet material having outer edge portions wrapped around the frame members. The sheet material has an open section that allows the handle elements to extend through the sheet material upon wrapping the sheet material around the frame members. The sheet material also has hook and fabric two component connectors along the outer edge portions of the sheet material to enable the outer edge portions to be wrapped around the frame members and be fastened together to hold the sheet material to the frame members. The hook component is along an edge of the sheet material and the fabric component is an interior fabric surface of the sheet material adjacent the hook component. One or more moveable flaps attached on an inside portion of the sheet material covers the open section and other frame portions so that the frame is essentially entirely covered upon attaching the sheet material to the frame members.

Six, our method of covering and uncovering the head of a golf club employs our golf club head cover, which forms an enclosure by the mating of the pair of complementary cover sections. Importantly, the pair of handle elements are accessible, for example, they may be along the longitudinal centerline in a backside of the enclosure, and adapted to be gripped between the thumb and one or more fingers by a user and depressed towards each other to move the cover sections so they pivot and spread apart into an open condition. According to our method, the user with one hand grips the handle elements and depresses them so the enclosure is in the open condition, maintains the grip on the handle elements to keep the enclosure in the open condition while placing the head of a golf club between the spread apart cover sections, or removing it. While in the open condition, with the head of a golf club between the spread apart cover sections, or removed therefrom, the user releases the grip on the handle elements so the cover sections come together. This opening and closing is done with only one hand of the user, while the user with the other hand places or removes the head of the club into or from, as the case may be, our opened head cover.

These features are not listed in any rank order nor is this list intended to be exhaustive.

DESCRIPTION OF THE DRAWING

Some embodiments of our golf club head cover and method of use are discussed in detail in connection with the accompanying drawing, which is for illustrative purposes only. This drawing includes the following figures (Figs.), with like numerals indicating like parts.

DETAILED DESCRIPTION OF SOME ILLUSTRATIVE EMBODIMENTS

General

Figure 1:
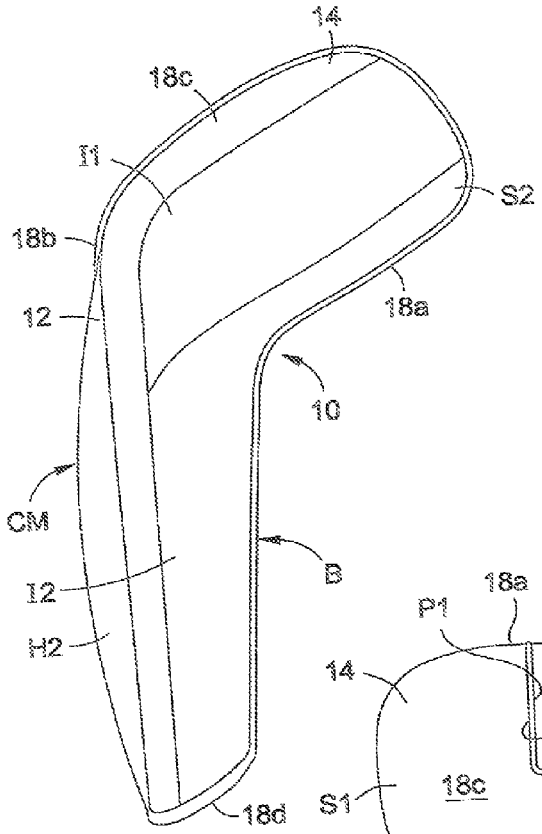
FIG. 1 is a side view of one embodiment of our golf club head cover.

As disclosed herein, our golf club head cover may have several different embodiments. The numeral 10 designates the embodiment of our golf club head cover shown in FIGS. 1 through 3A and FIGS. 4 through 11B; the numeral 10*a* designates the embodiment of our golf club head cover shown in FIG. 3B; the numeral 10*b* designates the embodiment of our golf club head cover shown in FIG. 3C; and the numeral 10*c* designates the embodiment of our golf club head cover shown in FIGS. 12A and 12B. The numeral 10*d* designates the embodiment of our golf club head cover shown in FIGS. 13 through 22. The numeral 10*e* designates the embodiment of our golf club head cover shown in FIGS. 22 and 24 for a right hand club, and the numeral 10*f* designates the embodiment of our golf club head cover shown in FIG. 23 for a left hand club. The numeral 10*g* designates the embodiment of our golf club head cover shown in FIG. 25. These embodiments are not in all respects equivalent.

All the embodiments include a body B comprising a pair of cover sections S1 and S2 and a manually actuated spring-biased clip member CM that normally holds the cover sections in a closed condition (FIGS. 1, 2, 3A through 3C, 11A, 20, 21, 22). The cover sections 51 and S2 each have a predetermined configuration so that, in the closed condition, the body B is adapted to substantially enclose a head H (phantom lines FIG. 11B) of a golf club. The body B has an open condition (FIGS. 11B, 12A and 12B, 18) enabling the head H to be received within or withdrawn from our open head cover. Each cover section 51 and S2 includes a perimeter P1 and P2, respectively. These perimeters P1 and P2 abut substantially along their entire extend when the body B is in the closed condition. A manually operable actuator mechanism, for example, a pair of handle elements H1 and H2 operably connected to and an integral part of a hinge 12 (FIGS. 4, 5, 10, and 12A, 13) of the clip member CM, projects outward from the exterior of the body B to enable a user with one hand to grip and operate the actuator mechanism, causing the cover sections 51 and S2 to at least partially separate and move into the open condition when depressed. Upon the user releasing his or her grip of the actuator mechanism, a spring element (leaf spring 30*a* FIGS. 6, 10, 21 and coiled spring 30*b* FIGS. 12A and 20) of the clip member CM rejoins the partially separated cover sections 51 and S2 to return the body B to its normally closed condition.

FIGS. 1 through 3A, and FIGS. 4 through 11B

Figure 2:
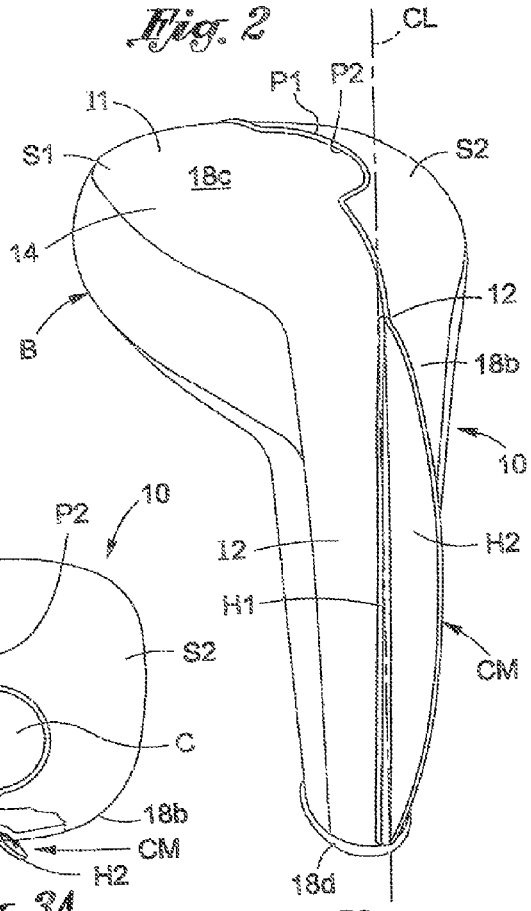
FIG. 2 is a rear perspective view of the embodiment of our golf club head cover shown in FIG. 1.

As illustrated in FIGS. 1 through 3A and FIGS. 4 through 11B, in the embodiment of our golf head cover designated by the numeral 10, the cover sections S1 and S2 each includes a rigid frame F1 and F2, respectively. The frames F1 and F2 may be injected molded from any suitable plastic and are covered by a flexible sheet material 14 that is shaped into the predetermined configuration of each cover section 51 and S2. This sheet material 14 may be a fabric, plastic or any suitable flexible material and it is bonded with an adhesive or otherwise attached to the frames F1 and F2. The sheet material 14 may be formed into any suitable shape that corresponds to the shape of the golf club head H being covered so the cover section 51 and S2 are complementary and each constitutes substantially half of the body B. As best illustrated in FIGS. 1 and 2, the body B in the closed condition thus forms an enclosure for the golf head H that has a front side 18*a*, a backside 18*b*, topside 18*c*, and a bottom side 18*d*.

Figure 5:
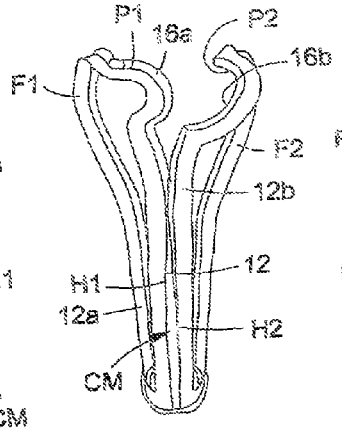
FIG. 5 is a rear perspective view of the pair of frames in the open condition depicted in FIG. 4.
Figure 6:
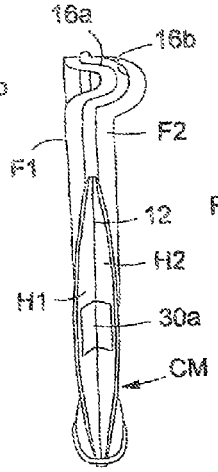
FIG. 6 is a rear view of the pair of frames depicted in FIGS. 4 and 5 shown in a closed condition.
Figure 7:
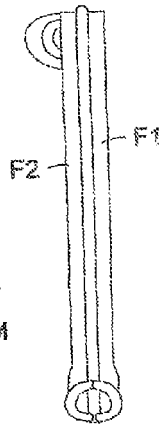
FIG. 7 is a front view of the pair of frames depicted in FIGS. 4 and 5 shown in a closed condition.
Figure 8:
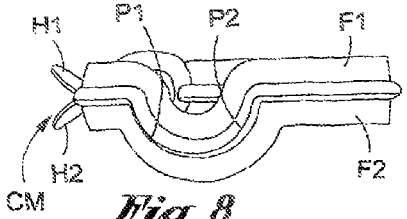
FIG. 8 is a top plan view of the pair of frames depicted in FIG. 7 in a closed condition.
Figure 9:
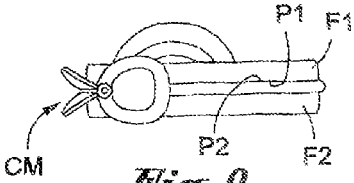
FIG. 9 is a bottom plan view of the pair of frames depicted in FIG. 7 in a closed condition.

The cover section 51 and S2 are substantially mirror images of each other except for their central top segments. As best shown in FIGS. 5 and 6, the cover section 51 has along its top central segment of its perimeter P1*a* laterally projecting portion 16*a* and the cover section S2 has along its top central segment of its perimeter P1*a* recess portion 16*b* that is aligned with and that receives the laterally projecting portion 16*b* when the body B is in the closed condition. The laterally projecting portion 16*a* and the recess portion 16*b* are each substantially semi-circular shaped and they have a common center C (FIG. 3A) when the body B is in the closed condition. The cover sections 51 and S2 are connected by the clip member CM, which is in the backside 18*b* and positioned to pivot about a longitudinal centerline CL along the backside of the body B. In the closed condition, the body B forms in an upper portion I1 an enlarged upper interior for a head of a golf club and in a lower portion I2 a lower reduced sized interior for a hosel of a golf club.

The frames F1 and F2 are components that respectively form the perimeters P1 and P2 of the cover sections S1 and S2 of this embodiment cover 10. These frames F1 and F2 may be molded from a plastic and each includes a rear portion 12*a* and 12*b*, respectively, forming a mounting element of an arm of the hinge 12. These arm portions 12*a* and 12*b* are hinged together substantially along the centerline CL in the backside 18*b* of the cover 10 and a leaf spring element 30*a* is connected to the arms in a manner that normally biases the clip member CM into a closed position (FIGS. 6 through 9), moving the cover sections 51 and S2 into the closed condition. Since each mounting element of an arm of the hinge 12 is integral with one frame F1 or F2, as the case may be, the cover section S1 is connected to one arm portion 12*a* and the other cover section S2 is connected to the other arm portion 12*b*.

Figure 10:
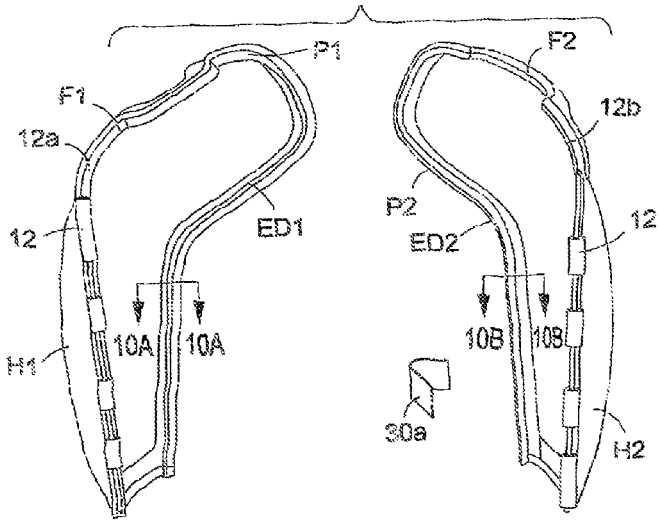
FIG. 10 is an exploded rear perspective view of the pair of frames depicted in FIGS. 4 and 5 facing each other.
Figure 10A:
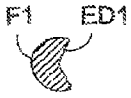
FIG. 10A is a cross-sectional view taken along line 10A-10A of FIG. 10 depicting the concave configuration of the perimeter of one frame.
Figure 10B:
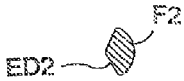
FIG. 10B is a cross-sectional view taken along line 10B-10B of FIG. 10 depicting the convex configuration of the perimeter of the other frame.
Figure 10C:
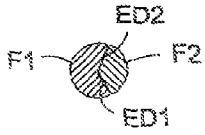
FIG. 10C is a cross-sectional view illustrating how the perimeters of the pair of frames engage and mate along their respective perimeters.

The handle elements H1 and H2 project from the connected cover sections S1 and S2 and are positioned opposite each other along a portion of the abutting perimeters P1 and P2. These handle elements H1 and H2 are oriented so that manually gripping and depressing them using only one hand overcomes the bias of the leaf spring element 30*a* to move the clip member CM to the open position by pivoting the hinged together arm portions 12*a* and 12*b* to separate the cover sections S1 and S2. This produces the open condition of the body B, which is maintained so long as the handle elements H1 and H2 are manually depressed. Upon release of manually gripping the handle elements H1 and H2 the leaf spring element 30*a* moves the partially separated cover sections S1 and S2 together to rejoin them along essentially the entire perimeters P1 and P2 to form the closed condition of the body B. As shown in FIGS. 10A through 10C, the perimeters P1 and P2 of each cover section S1 and S2 includes a mating segment, for example, the edge ED1 of the frame F1 may have a concave cross-sectional configuration and the edge ED2 of the frame F2 may have a convex cross-sectional configuration. These complementary mating segments mate when the body B is in the closed condition as depicted in FIG. 10C.

Figure 3A:
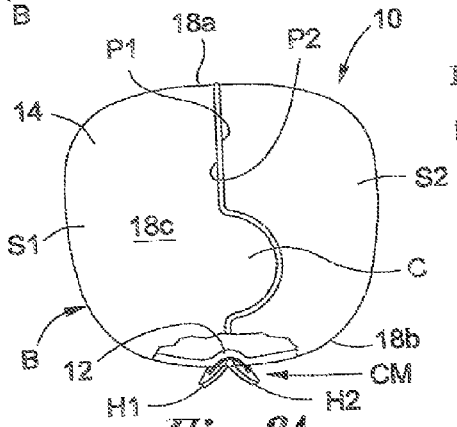
FIG. 3A is a top plan view, with sections broken away, of the embodiment of our golf club head cover shown in FIG. 1.
Figure 3B:
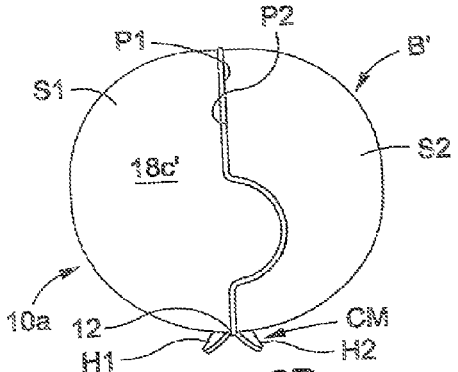
FIG. 3B is a top plan view of one alternate embodiment of our golf club head cover having a circular topside.
Figure 3C:
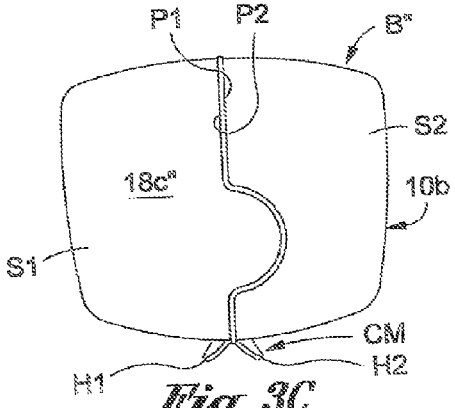
FIG. 3C is a top plan view of another alternate embodiment of our golf club head cover having a substantially rectangular topside.
Figure 4:
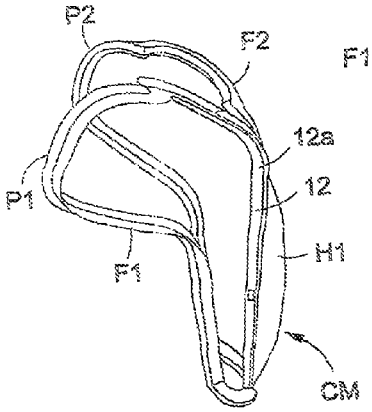
FIG. 4 is a side perspective view of a pair of frames, shown in an open condition, forming in part a pair of cover sections of the embodiment of our golf club head cover shown in FIG. 1.

FIGS. 3A and 3B

The embodiment of our golf club head cover designated by the numeral 10*a* depicts a body B' where its topside 18*c*' has a circular configuration and the embodiment of our golf club head cover designated by the numeral 10*b* depicts a body B" where its topside 18*c*" has a substantially rectangular configuration. Otherwise these cover members 10*a* and 10*b* are essentially the same as the cover member 10.

Figure 12A:
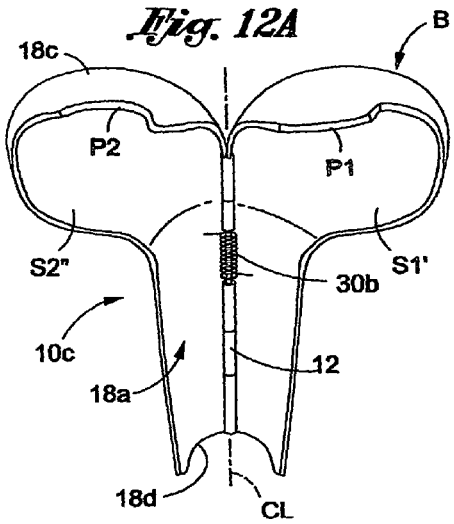
FIG. 12A is a front view of yet another embodiment of our golf club head cover in the open condition.
Figure 12B:
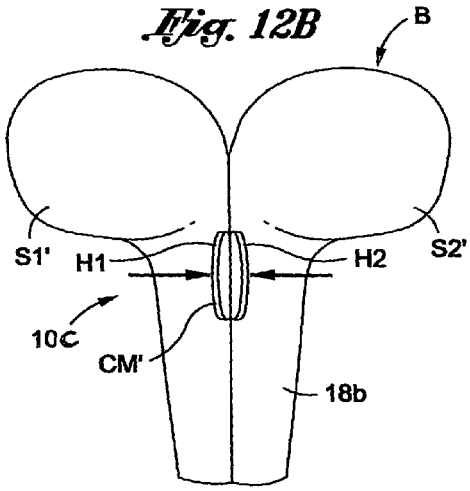
FIG. 12B is a rear view of the embodiment of our golf club head cover shown in FIG. 12A in the open condition.

FIGS. 12A and 12B

The embodiment of our golf club head cover designated by the numeral 10*c* depicts a cover member CM' having its cover sections S1' and S2' each molded from a plastic. The cover sections S1' and S2' are substantially rigid and the hinge H has a coiled spring 30*b* oriented lengthwise along the centerline CL of the backside 18*b*.

FIGS. 13 through 20

Figures 13, 13A, 13B, 13C:
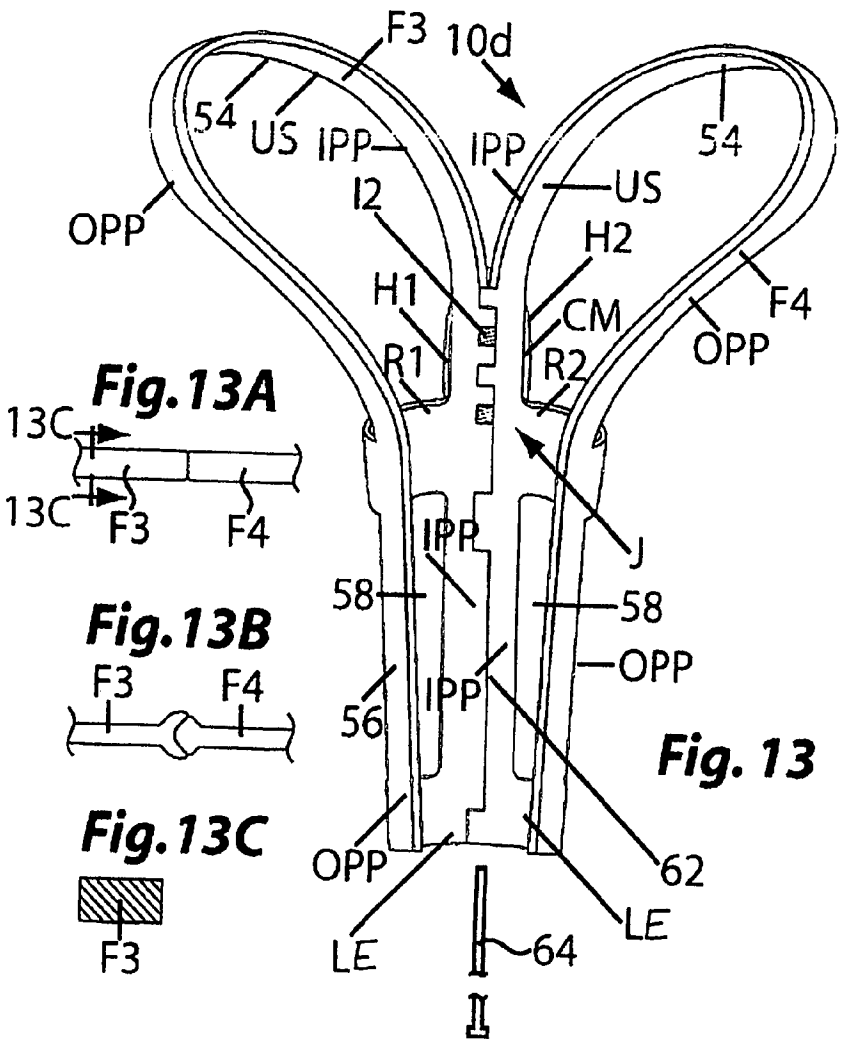
FIG. 13 is a front elevational view of an open frame used with another embodiment of our golf club head cover.
FIG. 13A is a fragmentary view of frame sections abutting each other with their abutting ends having male and female mating portions.
FIG. 13B is a fragmentary view of frame sections abutting each other.
FIG. 13C is a cross-sectional view taken along line 13C-13C of FIG. 13A.
Figure 14:
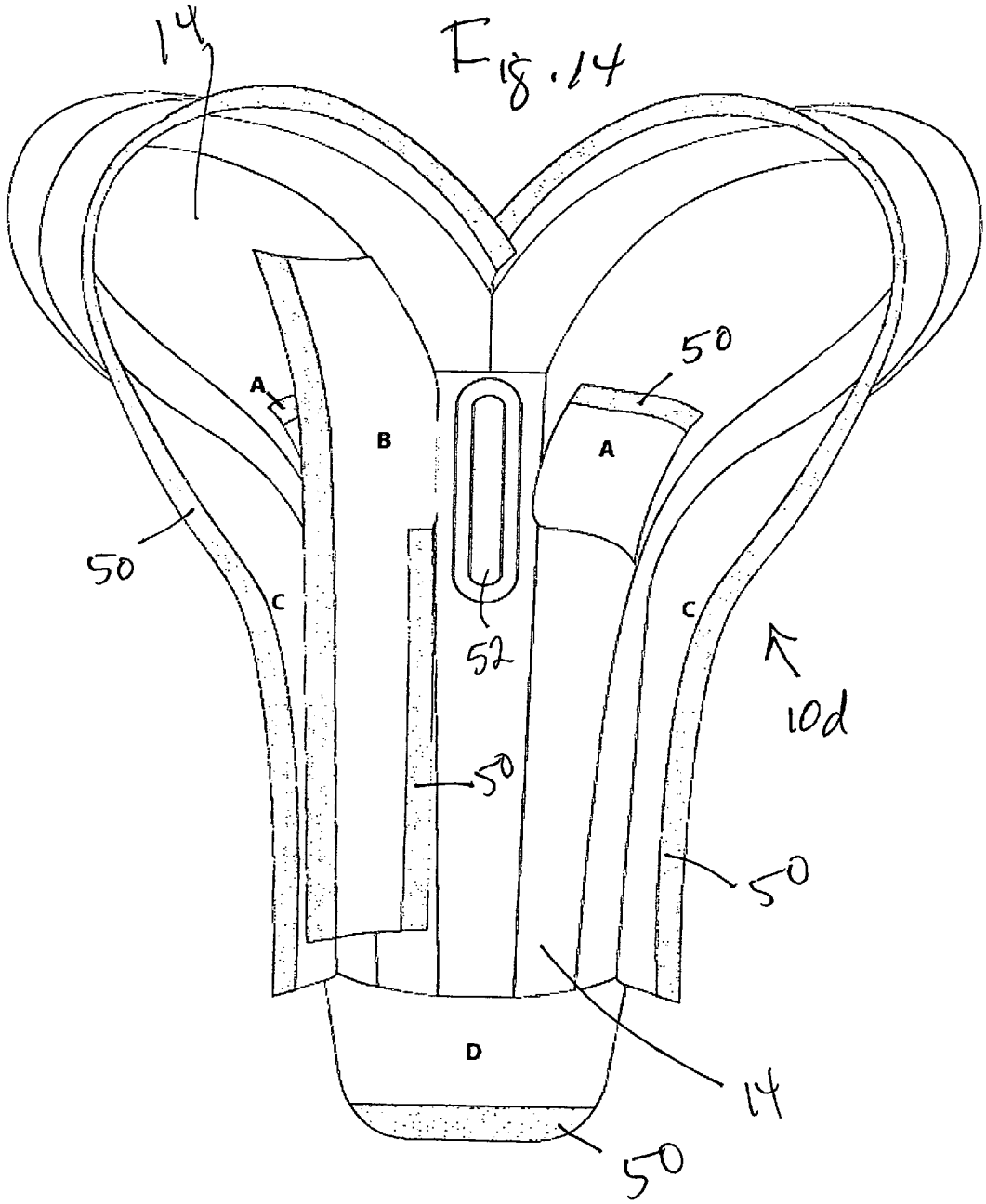
FIG. 14 is a front elevational view of sheet material configured to be wrapped around the frame shown in FIG. 13.
Figure 15:
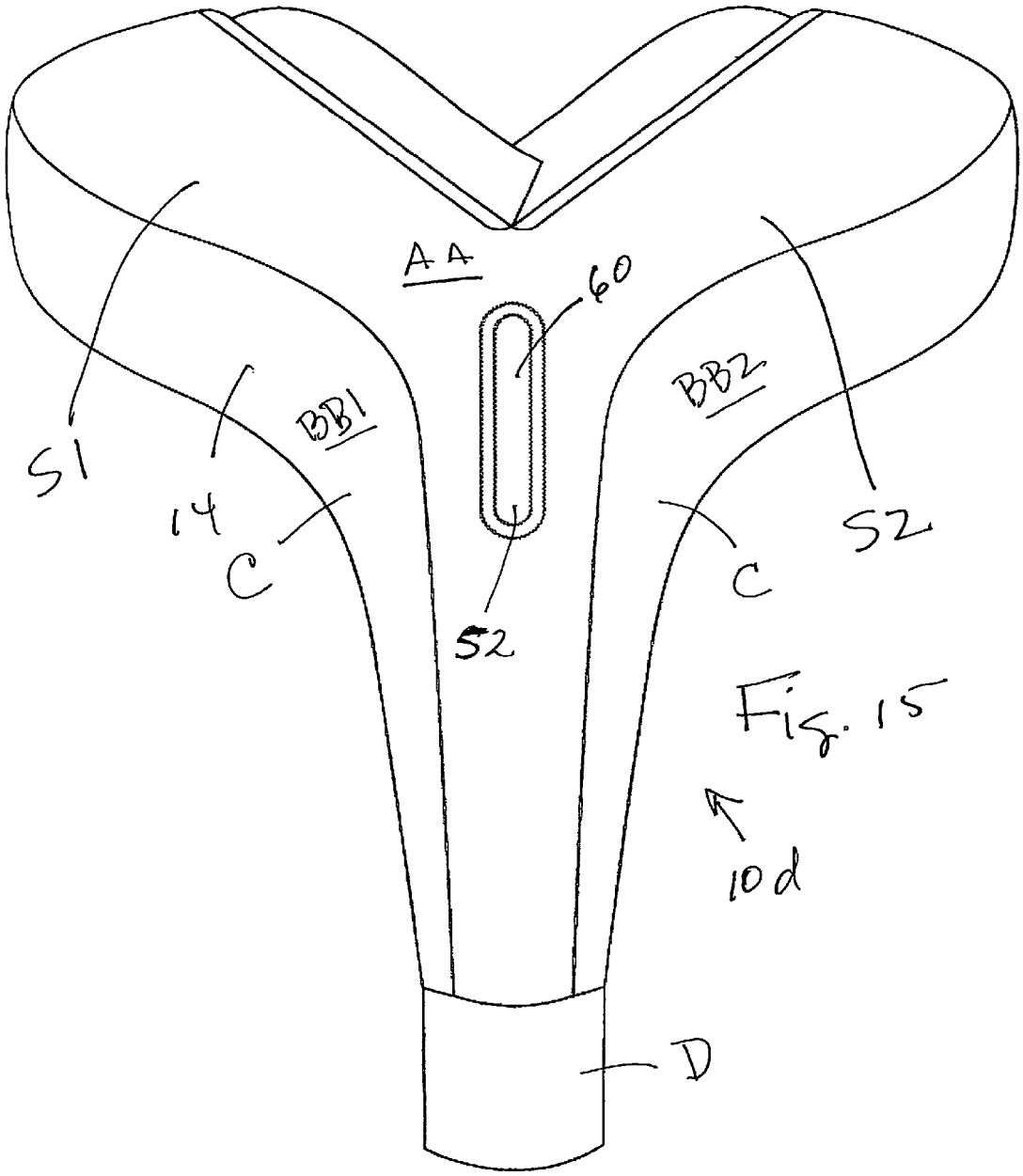
FIG. 15 is a rear elevational view of sheet material configured to be wrapped around the frame shown in FIG. 13.
Figure 15A:
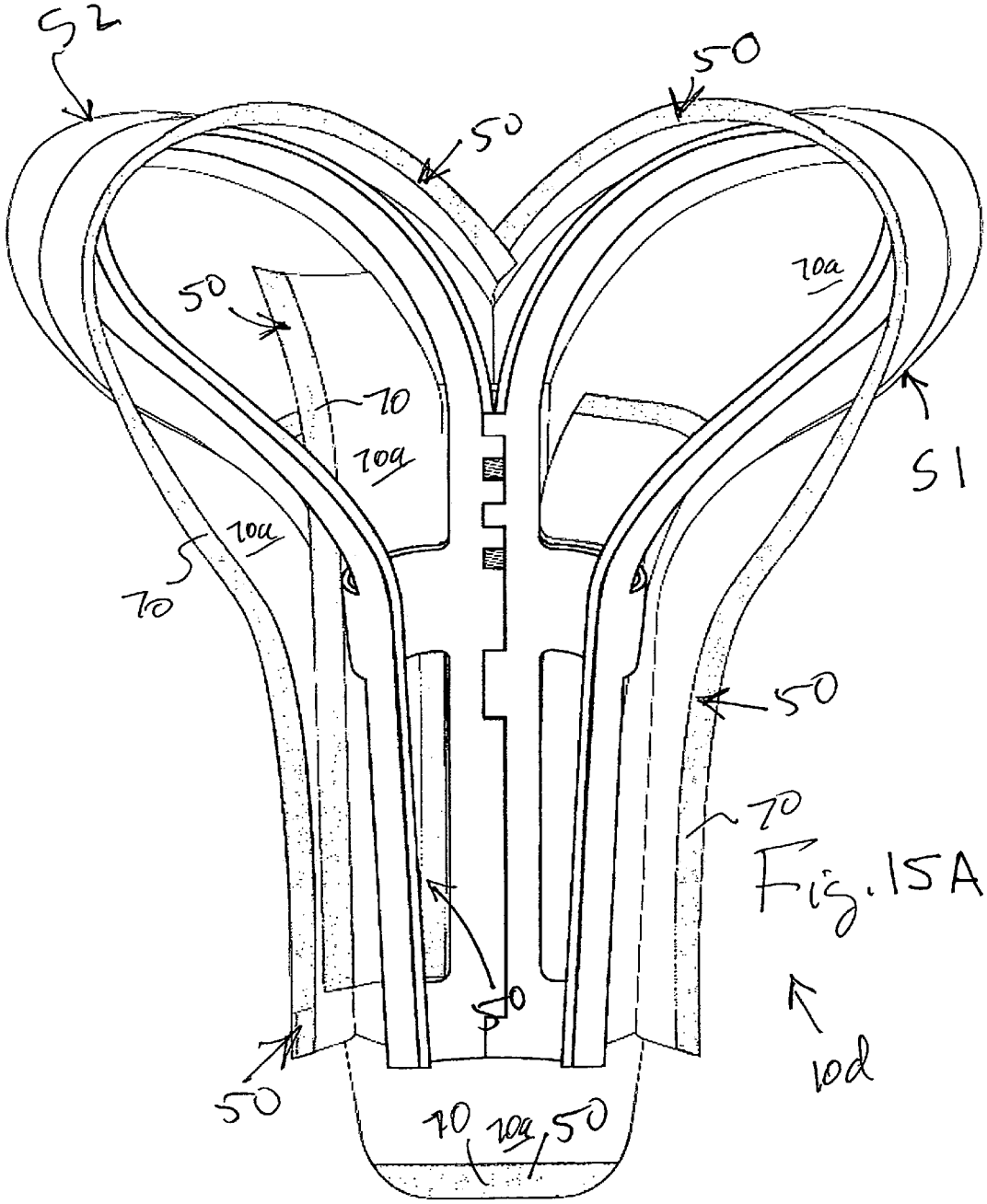
FIG. 15A is a front elevational view of the sheet material shown in FIGS. 14 and 15 being wrapped around the open frame shown in FIG. 13.
Figure 16:
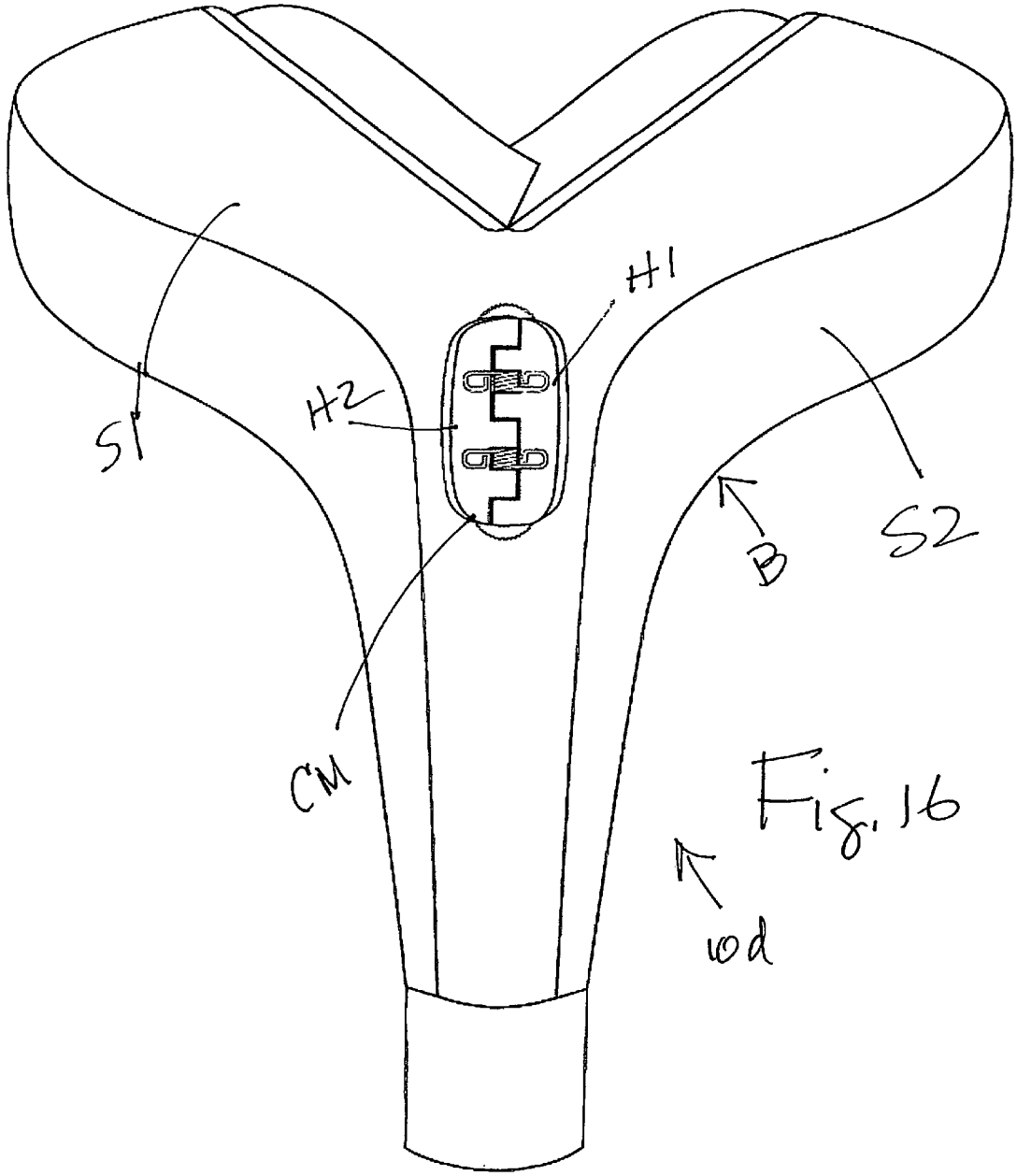
FIG. 16 is a rear elevational view of the sheet material shown in FIGS. 14 and 15 partially wrapped around the frame shown in FIG. 13.
Figure 18:
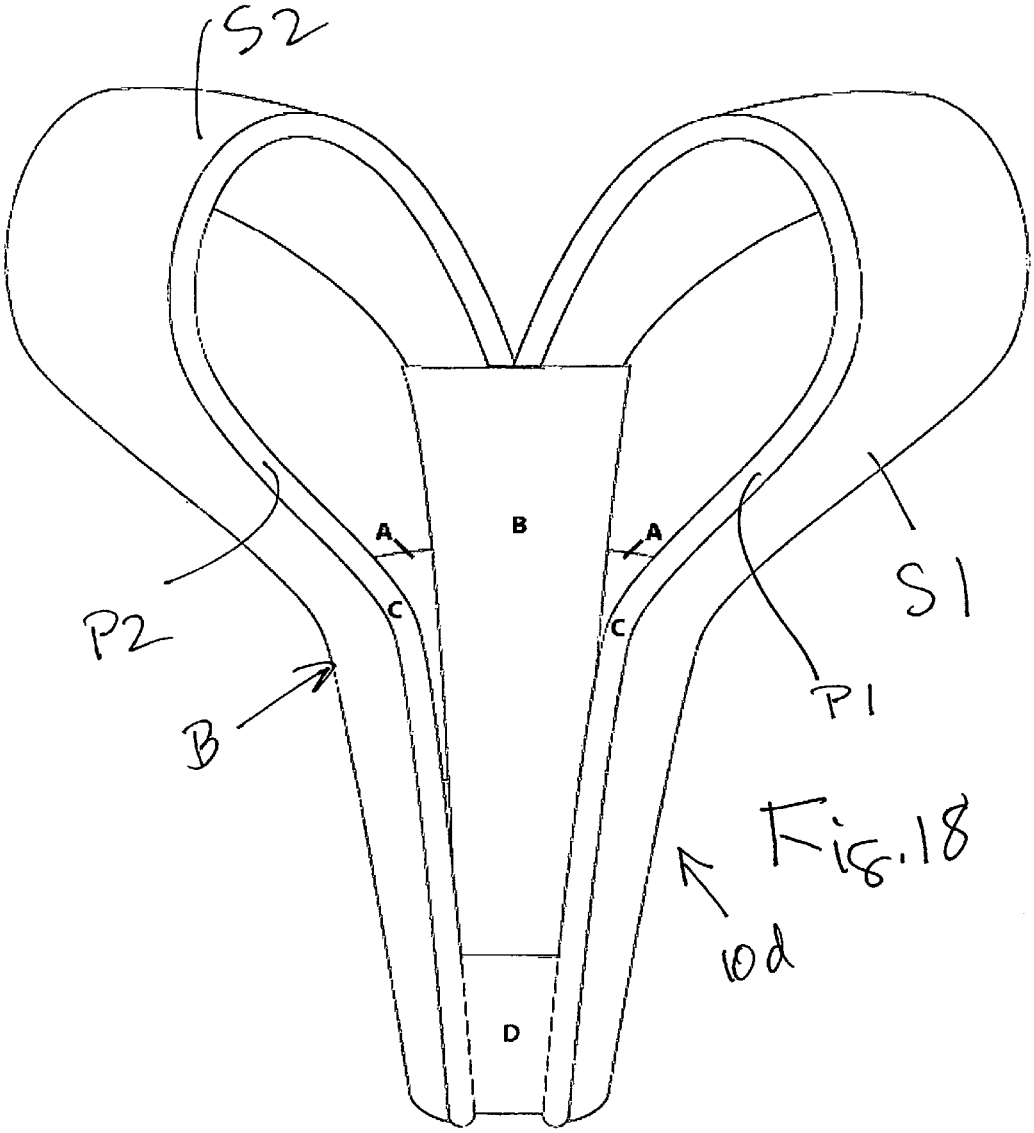
FIG. 18 is a front elevational view of our golf club head cover with the sheet material completely wrapped around the open frame and two component hook and fabric connectors attached to fasten the sheet material to the frame.
Figure 19:
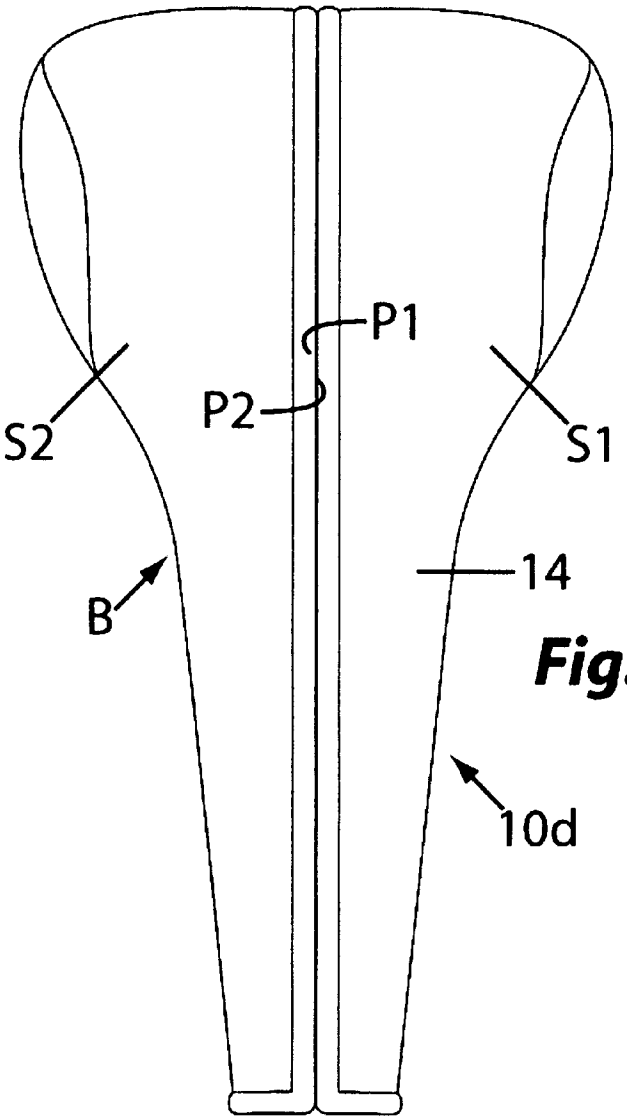
FIG. 19 is a front elevational view of our golf club head cover in a closed condition with the sheet material completely wrapped around the open frame and two component hook and fabric connectors attached to fasten the sheet material to the frame.
Figure 20:
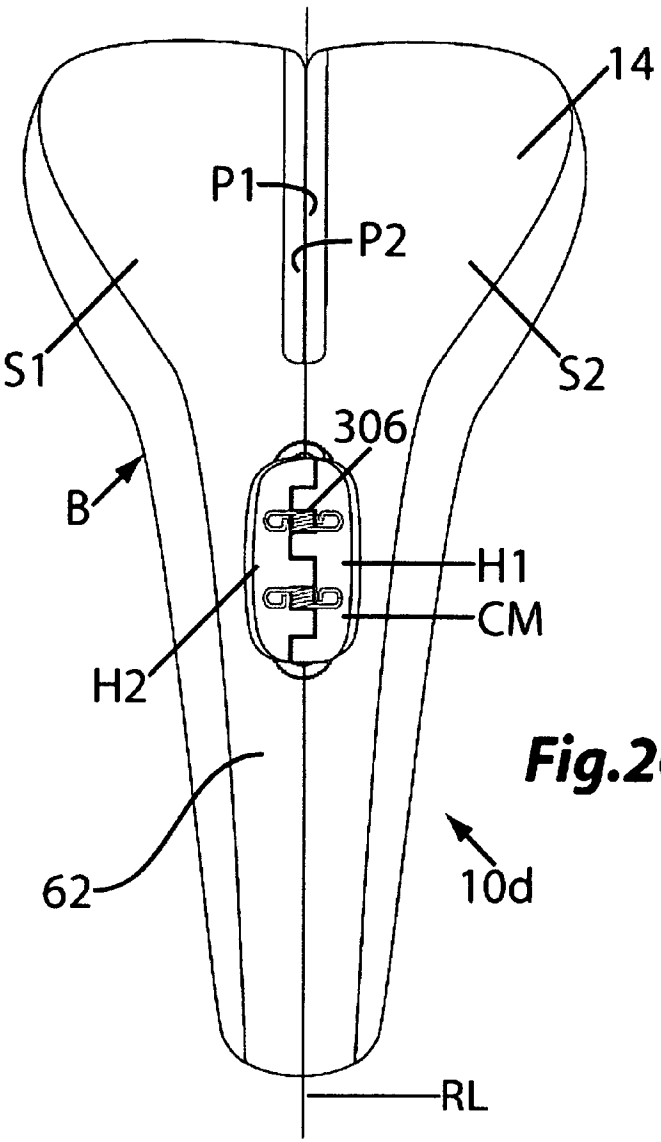
FIG. 20 is a rear elevational view of our golf club head cover in a closed condition with the sheet material completely wrapped around the open frame and two component hook and fabric connectors attached to fasten the sheet material to the frame.

The embodiment of our golf club head cover designated by the numeral 10*d* depicts using a sheet material 14 (FIG. 14) having flap portions A, B, C and D with hook and fabric two component connectors 50 along edges of these flap portions. As best illustrated in FIG. 15A, a hook component 70 is an array of hooks on the inside surfaces of the flap portions A, B, C and D and the fabric component 70*a* is an internal fabric surface adjacent the array of hooks. The sheet material may be fabric sections sown together and includes an oblong central opening 52 that receives the clip member CM when the sheet material 14 is wrapped around the frame shown in FIG. 13. The sheet material may be multi-layers including an outer layer of a flexible plastic covering a layer of fabric, which may be a foam plastic sheet covered on both sides with a fabric. For example, as shown in FIG. 15, an outer sheet portion AA may be a Y-shaped plastic sheet portion having a pair of foam sheets covered with a fabric to form the two flaps C along the opposed sides S4 and S5 of the Y-shaped plastic sheet. These three main sheet portions are sewn together to form a connecting seam 80 at the junction between the sides S4 and S5 and the flaps C. The flaps C and folded inward so they are about at a right angle with respect to the Y-shaped plastic sheet AA. As with the other embodiments, our golf club head cover 10*d* has a body B including a pair of cover sections S1 and S2, each section including a frame member F3 and F4, respectively (FIG. 13). The clip member CM connects the cover sections S1 and S2 and has handle elements H1 and H2 projecting from the connected cover sections that are positioned opposite each other on opposed sides of a longitudinal reference line RL. As shown in FIG. 20 where the cover sections S1 and S2 are connected to the clip member CM. In FIG. 18, the clip member's handle elements H1 and H2 are depressed to open our golf club head cover 10*d*. Upon release of manually gripping the handle elements H1 and H2, separated cover sections S1 and S2 rejoin to provide a closed condition of the body that covers the head and hostel of a golf club, as shown In FIGS. 19 and 20.

As best shown in FIG. 13, each frame member F3 and F4 forms a loop structure with an inner perimeter portion IPP and a outer perimeter portion OPP and a centrally located rib element R1 and R2 substantially at a right angle to the longitudinal reference line RL that connects the inner and outer perimeter portions and divides the frame member into an upper segment US and a lower segment LS. The clip member CM is located at or near a junction J between the upper segment US and lower segment LS. The upper segment US has a substantially curved portion 54 with a substantially uniform rectangular cross-section as shown in FIGS. 13A and 13C. The lower segment provides a substantially semi-cylindrical wall 56 with open windows 58 therein. The wall 56 may taper inward towards its lower end LE. Upon closure of our cover 10*d*, there is provided an enlarged upper enclosure for a head of a golf club and a lower reduced sized diameter enclosure for a hosel of a golf club.

Figure 17:
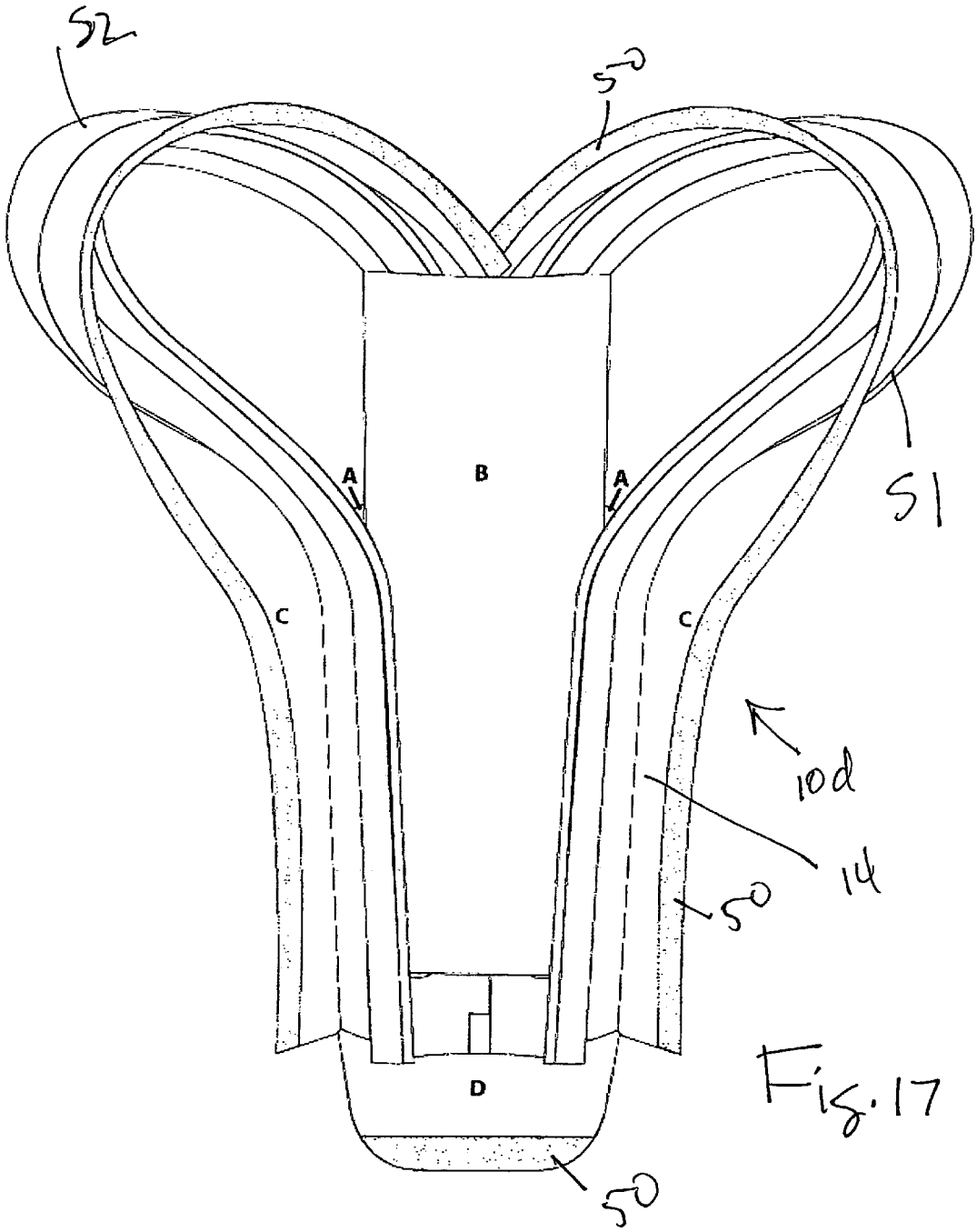
FIG. 17 is a front elevational view of the sheet material shown in FIGS. 14 and 15 partially wrapped around the frame shown in FIG. 13 with internal flaps folded to cover the hinge.
Figure 21:
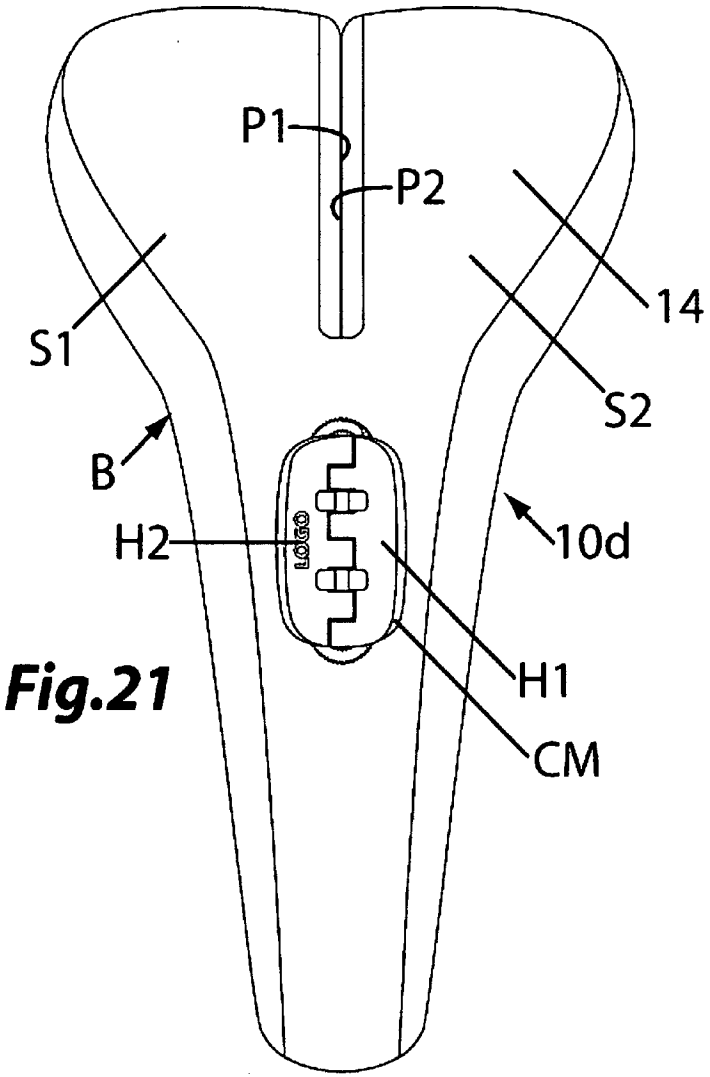
FIG. 21 is a rear elevational view of our golf club head cover in a closed condition similar to that of FIG. 20 using a different spring clip.

As shown in FIG. 15, the oblong central opening 52 allows the handle elements H1 and H2 to extend through the sheet material upon wrapping the sheet material around the frame members as depicted in FIGS. 20 and 21. As illustrated in FIGS. 15A, 17, and 18, the sheet material has hook and fabric two components connectors 50 positioned to enable outer edge portions to be wrapped around the frame members F3 and F4 to hold the sheet material to the frame members. The internal moveable flap portions A, B, C and D attached on an inside portion of the sheet material 14 upon folding covers the oblong central opening 52 (an open section) along with portions of the frame upon attaching the sheet material to the frame members F3 and F4.

Our golf club head cover 10*d* thus provides a rigid skeletal structure with the hinge extending substantially the entire length of the spine 62 (FIGS. 13 and 20) of our cover formed by the abutting frame members F3 and F4. A hinge pin 64 (FIG. 13) is insert along the spine 62 and is integral therewith and extends substantially along the entire length of the spine where the frame member F3 and F4 abut.

FIGS. 21-24

Figure 22:
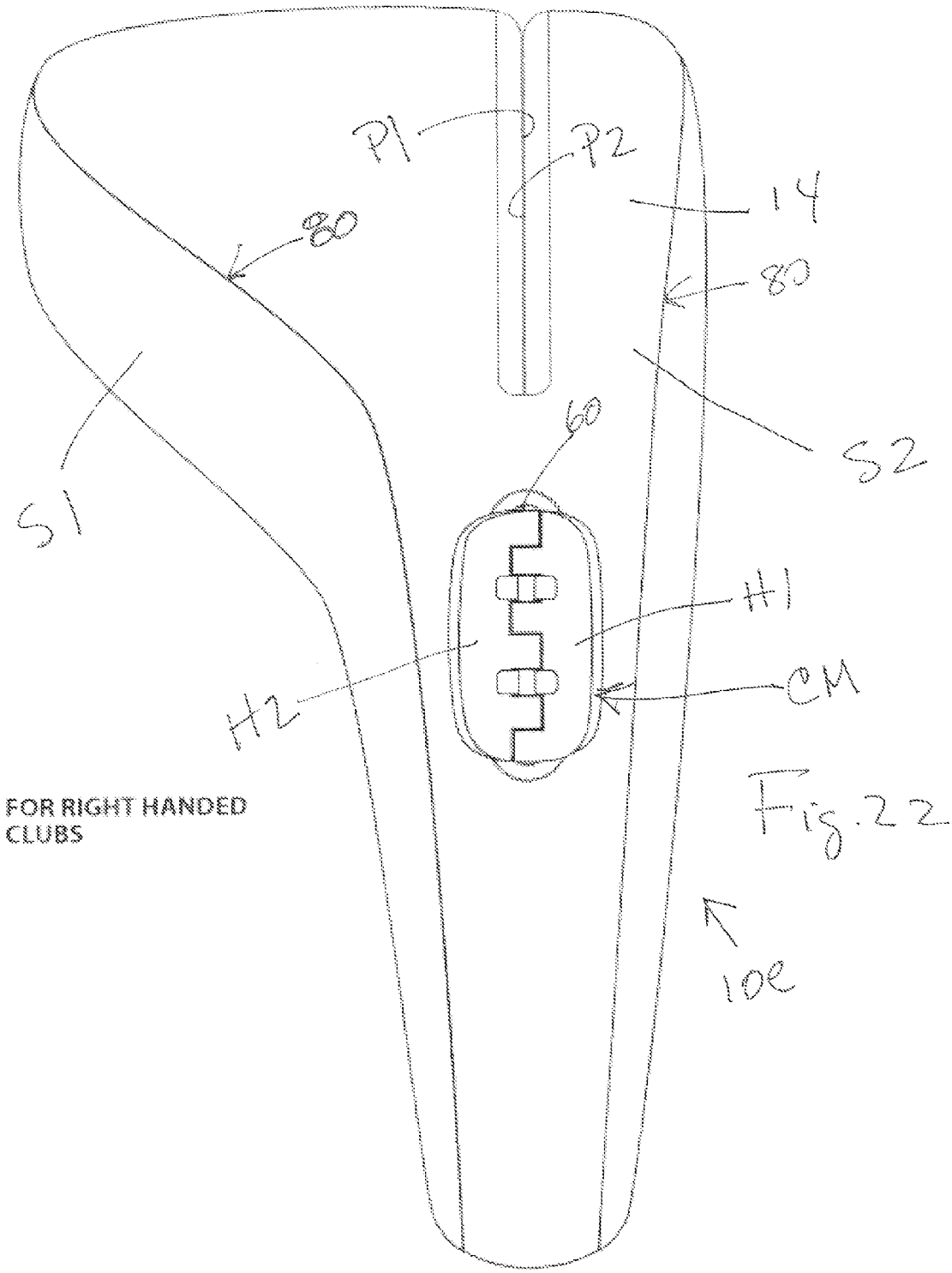
FIG. 22 is a rear elevational view of another embodiment of our golf club head cover for an enlarged golf club head of a right-handed club.
Figure 23:
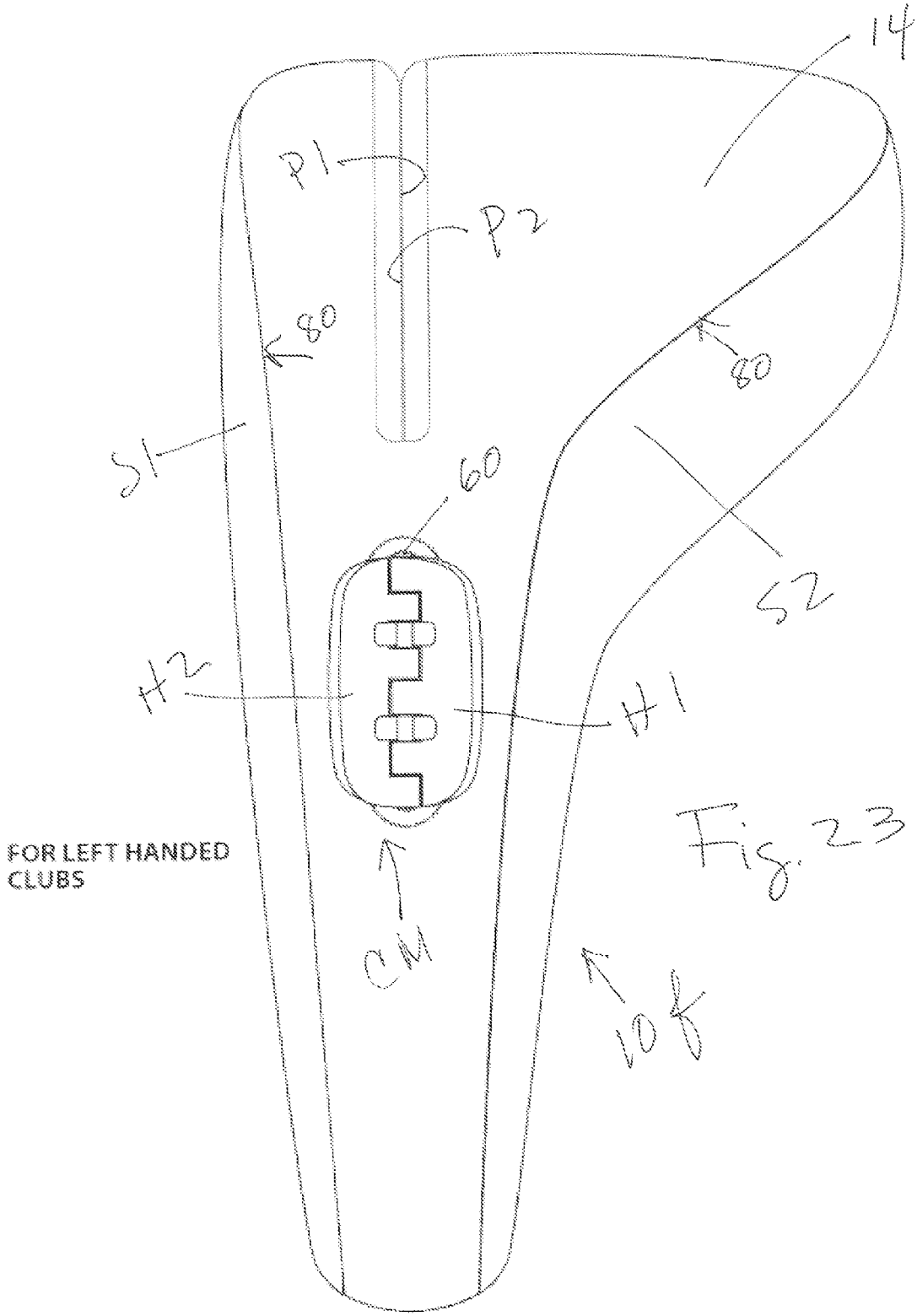
FIG. 23 is a rear elevational view of another embodiment of our golf club head cover for an enlarged golf club head of a left-handed club.

The cover member 10*e* illustrated in FIG. 22 and the cover member 10*f* illustrated in FIG. 23 the show that the section S1 and S2 may be of different sizes. In FIG. 22 the section S1 of cover member 10*e* is greater in volume than the section S2, so it is suitable for a right-handed club. In FIG. 23 the section S2 of cover member 10*e* is greater in volume than the section S1, so it is suitable for a left-handed club.

Figure 24:
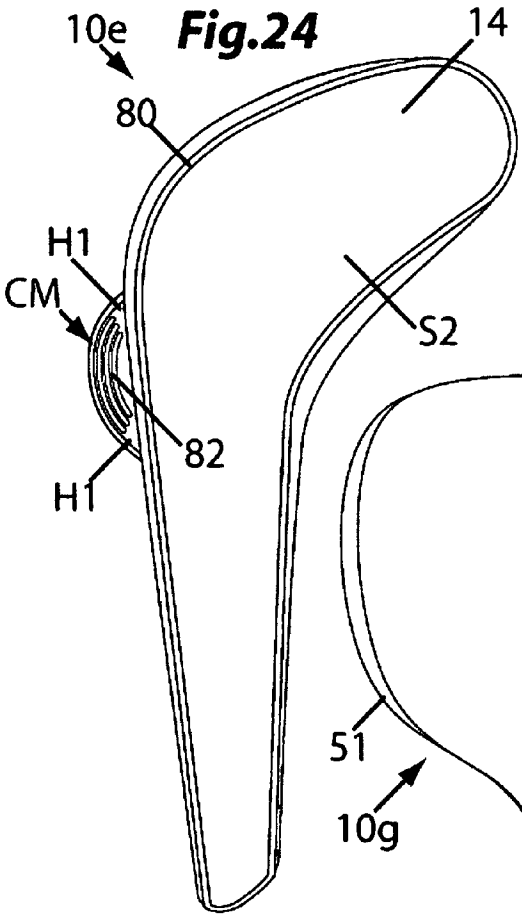
FIG. 24 is a side elevational view of our golf club head cover shown in FIG. 22 illustrating a non-slip gripping surface of the clip member.

As depicted in FIG. 24, the handles H1 and H2 (only one shown) of the clip member CM may be molded from any suitable plastic and include ridges 82 therein that minimize slip. These ridges 82 may be a series of segments of concentric circles on the exterior surface of the handles H1 and H2 of the clip member CM.

FIG. 25

Figure 25:
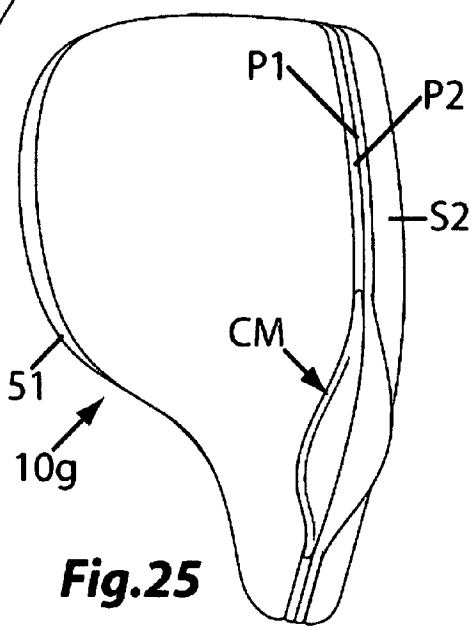
FIG. 25 is a rear perspective view of another embodiment of our golf club head cover having a square or cubic-like shape.

The cover member 10*g* illustrated in FIG. 25 illustrates that the use of the frames F3 and F4 enables the shape of the cover member to be configured into a square or cubical shape not easy to otherwise achieve.

Method of Use

Figure 11A:
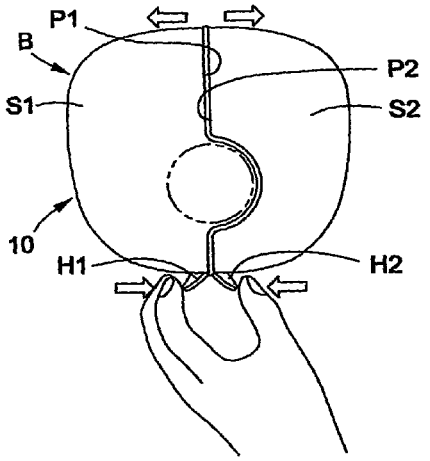
FIG. 11A is a top plan view showing a user gripping the handle elements of the embodiment of our golf club head cover shown in FIG. 1.
Figure 11B:
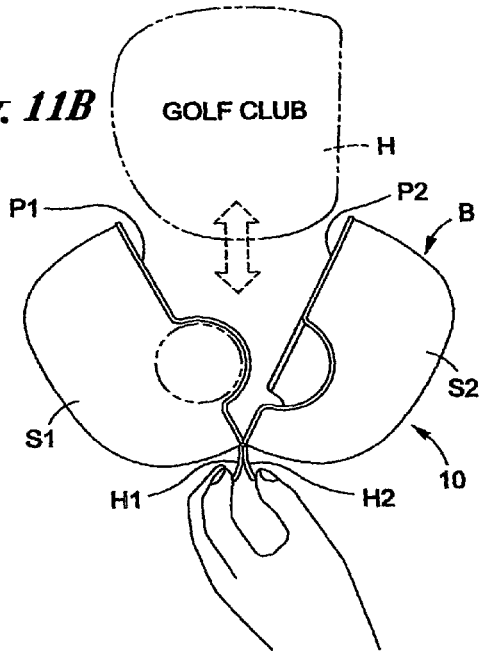
FIG. 11B is a top plan view similar to that of FIG. 11A showing the user depressing the handle elements to place our golf club head cover in the open condition, and while maintaining the grip on the handle elements, inserting the head of a golf club between the partially separated cover sections of our golf club head cover.

All the embodiments of our golf head cover member as discussed above are used in the same way, namely, a user inserts or removes the golf club head H from between the separated cover sections using only one hand to hold the cover member in the open position. The handle elements H1 and H2 projecting outward from the backside 18*b* of the body B are easily accessible by the user and are adapted to be gripped between the user's thumb and one or more fingers. The user grips the handle elements H1 and H2 with one hand as depicted in FIG. 11A, and then using only the one hand depresses these handle elements towards each other as depicted in FIG. 11B. Depressing the handle elements H1 and H2 moves the cover sections S1 and S2 so they pivot about the centerline CL and spread apart into the open condition adapted to receive or withdraw the head H of a golf club. While the user maintains his or her grip on the handle elements H1 and H2 to keep the body B in the open condition, the user with his or her other hand places the head of a golf club between the spread apart cover sections S1 and S2, or withdraws it. When the head of a golf club is between the spread apart cover sections S1 and S2, or removed therefrom, the user releases his or her grip on the handle elements H1 and H2 so the leaf spring 30*a* or the coiled spring 30*b*, as the case may be, urges the cover sections to come together into the closed condition. Thus, with only one hand and with a single grip-hold-release action is able to manipulate our golf club head cover and open and close it.

Scope of the Invention

The above presents a description of the best mode we contemplate of carrying out our golf club head cover, and of the manner and process of making and using it, in such full, clear, concise, and exact terms as to enable any person skilled in the art to which it pertains to make and use our golf club head cover. Our golf club head cover is, however, susceptible to modifications and alternate constructions from the illustrative embodiments discussed above which are fully equivalent. Consequently, it is not the intention to limit our golf club head cover to the particular embodiments disclosed. On the contrary, our intention is to cover all modifications and alternate constructions coming within the spirit and scope of our golf club head cover as generally expressed by the following claims, which particularly point out and distinctly claim the subject matter of our invention:

The invention claimed is:

1. A golf club head cover comprising a body having an open condition enabling the body to receive the head of a golf club and a closed condition substantially enclosing said head therein, said body including a pair of cover sections each with a predetermined configuration and each including a perimeter, said perimeters abutting when the body is in the closed condition, and a clip member connecting the cover sections and having an open position and a closed position, said clip member including a pair of arms hinged together and a spring element connected to the arms to normally bias the clip member into the closed position, each arm including a mounting element and a handle element, one cover section being connected to the mounting element of one arm and the other cover section being connected to the mounting element of the other arm, said handle elements projecting from the connected cover sections and positioned opposite each other along a portion of the abutting perimeters and oriented so that manually gripping and depressing the handle elements using only one hand overcomes the bias of the spring element to move the clip member to the open position by pivoting the hinged together arms to separate the cover sections to form the open condition of the body so long as the handle elements are manually depressed and, upon release of manually gripping the handle elements, said spring element moving the separated cover sections together to rejoin said cover sections along said perimeters to form the closed condition of the body, each cover section including a rigid frame forming a substantial portion of the perimeter of the frame's corresponding cover section and each frame having attached thereto sheet material covering the frame, each said frame having a substantially flat upper curved portion with a substantially uniform rectangular cross-section, the sheet material has an open section that allows the handle elements to extend through the sheet material upon wrapping the sheet material around the frame, said sheet material having hook and fabric two components connectors positioned to enable outer edge portions to be wrapped around the frame to hold the sheet material to the frame, and including a moveable flap attached on an inside portion of the sheet material that covers the open section upon attaching the sheet material to the frame.

2. The golf club head cover of claim 1 where at least one handle element having on its surface ridge members that minimizes slip.

3. The golf club head cover of claim 1 where an off center reference line divides the body into a large cover section and a much smaller cover section.

4. The golf club head cover of claim 1 having a substantially cubical configuration.

5. A golf club head cover comprising a body providing an enclosure formed by a pair of complementary cover sections, said cover sections each including a frame member and said frame members being connected to pivot about a longitudinal reference line along a backside of the body by a manually actuated spring-biased clip member that normally biases the cover sections into a closed condition adapted to enclose a head of a golf club, said clip member being in the backside of the body and including a pair of handle elements projecting outward from the backside of the body that are adapted to be gripped between the thumb and one or more fingers by a user and depressed towards each other to move the cover sections so they pivot and spread apart into an open condition in a front side of the body that is adapted to receive the head of a golf club, said frame members being covered by a flexible sheet material having outer edge portions wrapped around the frame members, said sheet material having an open section that allows the handle elements to extend through the sheet material upon wrapping the sheet material around the frame members and hook and fabric two component connectors along said outer edge portions of the sheet material to enable said outer edge portions to be wrapped around the frame members and fastened together to hold the sheet material to the frame members, and including a moveable flap attached on an inside portion of the sheet material that covers the open section upon attaching the sheet material to the frame members.

6. The golf club head cover of claim 5 including an enlarged upper enclosure for a head of a golf club and a lower reduced sized enclosure for a hosel of a golf club.

7. The golf club head cover of claim 5 where the cover sections have abutting perimeters in the closed position and the handle elements are positioned opposite each other along a portion of the abutting perimeters and oriented so that manually gripping and depressing the handle elements using only one hand overcomes the spring bias of the clip member to move the cover sections into the open condition so long as the handle elements are manually depressed and, upon release of manually gripping the handle elements, the separated cover sections rejoin along said perimeters to form the closed condition of the body.

8. The golf club head cover of claim 5 where at least one handle element having on its surface ridge members that minimizes slip.

9. The golf club head cover of claim 5 where an off center reference line divides the body into a large cover section and a much smaller cover section.

10. The golf club head cover of claim 5 having a substantially cubical configuration.

11. A golf club head cover comprising a body including a pair of cover sections, each section including a frame member, a clip member connecting the cover sections and having handle elements projecting from the connected cover sections that are positioned opposite each other on opposed sides of a longitudinal reference line where the cover sections are connected to the clip member, upon release of manually gripping the handle elements, separated cover sections rejoin to provide a closed condition of the body that covers the head and hostel of a golf club, each said frame member forming a loop structure with an inner perimeter portion and a outer perimeter portion and a centrally located rib element substantially at a right angle to the longitudinal reference line that connects the inner and outer perimeter portions and divides the frame member into an upper segment and a lower segment, said clip member located at or near a junction between the upper and lower segments, said upper segment having a substantially curved portion with a substantially uniform rectangular cross-section and said lower segment provides a substantially semi-cylindrical wall, the cover sections having a sheet material with an open section that allows the handle elements to extend through the sheet material upon wrapping the sheet material around the frame members, said sheet material having hook and fabric two component connectors positioned to enable outer edge portions of the sheet material to be wrapped around the frame members to hold the sheet material to the frame, and including a moveable flap attached on an inside portion of the sheet material that covers the open section upon attaching the sheet material to the frame members.

12. The golf club head cover of claim 11 where at least one handle element having on its surface ridge members that minimizes slip.

13. The golf club head cover of claim 11 where an off center reference line divides the body into a large cover section and a much smaller cover section.

14. The golf club head cover of claim 11 having a substantially cubical configuration.

15. A golf club head cover comprising a body including a pair of hinged cover sections, each section including a frame member, a clip member connecting the cover sections and having handle elements projecting from the connected cover sections that are positioned opposite each other on opposed sides of a longitudinal reference line where the cover sections are connected to the clip member, upon release of manually gripping the handle elements, separated cover sections rejoin to provide a closed condition of the body that covers the head and hostel of a golf club, each said frame member forming a loop structure with an inner perimeter portion and a outer perimeter portion and a centrally located rib element substantially at a right angle to the longitudinal reference line that connects the inner and outer perimeter portions and divides the frame member into an upper segment and a lower segment, each said upper segment of the frame having a substantially flat curved portion with a substantially uniform rectangular cross-section and said lower segment providing a substantially semi-cylindrical wall in the closed condition, said clip member located at or near a junction between the upper and lower segments.

* * * * *